United States Patent [19]

Tyler

[11] 4,038,748

[45] Aug. 2, 1977

[54] ROTARY DRY SHAVER WITH TILTABLE SHEAR PLATES

[76] Inventor: Tracy B. Tyler, 7936 Byron Ave., Miami Beach, Fla. 33141

[21] Appl. No.: 238,426

[22] Filed: Mar. 27, 1972

[51] Int. Cl.[2] ..... B26B 19/14

[52] U.S. Cl. ..... 30/43.6

[58] Field of Search ..... 30/43.4, 43.5, 43.6, 30/43.1, 346.51

[56] References Cited

U.S. PATENT DOCUMENTS

| | | | |
|---|---|---|---|
| 2,952,908 | 9/1960 | Starre | 30/346.51 X |
| 3,242,569 | 3/1966 | Driest | 30/43.5 |
| 3,694,915 | 10/1972 | Beusink | 30/43.5 |

*Primary Examiner*—Gary L. Smith

[57] ABSTRACT

A rotary dry shaver comprising a component housing, a pair of tiltable cutting elements with exposed apertured shear plates, a bladed rotary cutting member cooperative with the inner surface of the shear plates and coactively tiltable therewith, a driving shaft for the cutting members, the shear plates and cutting members normally disposed at a right angle to the shaft axes, the cutting elements supported axially on a peripherally disposed coiled spring whereon they are freely tiltable at diverse angles relative to the shaft axes, a removable cutting element retaining frame with apertures through which a portion of each of the cutting elements projects, and a chamber beneath the said frame to receive hair clippings.

4 Claims, 3 Drawing Figures

ROTARY DRY SHAVER WITH TILTABLE SHEAR PLATES

SUMMARY OF THE INVENTION

The present invention relates to rotary dry shavers and is a modified embodiment of and complementary to the invention disclosed and described in my U.S. Pat. No. 3,715,803 issued Feb. 13, 1973 entitled the same as hereinabove, this modification primarily residing in provision of resilient means instead of spherically radiused means to achieve shear plate tiltability.

As stated in my copending application, various rotary dry shavers have been introduced which comprise two or more apertured shear plates which are tiltable and which include a bladed rotary cutting member cooperative with the shear plates and coactively tiltable therewith, but in such previously known structure the shear plates (usually retained in a frame) are made tiltable by primarily supporting them on the cutting member blades, the latter being tiltably supported on one end of an axially spring biased driving shaft under a very light pressure. However, because the apertured shearing portion of the plates must be extremely thin to effect a close shave they are consequently very fragile. Therefore, were they fully supported on the cutting member blades a relatively heavy pressure in shaving or handling could cause the blades to break through the fragile thin shell of the plate shearing portions. For this reason, when primary support on spring biased blades constitutes the structure by which the shear plates are made tiltable, a secondary and solid support must be provided on which the under portion of the shear plates come to rest after they have been depressed a preset distance together with the spring biased blades, and since the secondary support must uniformly limit the plate depression at all points they are now resting in a flat plane and no longer tiltable. This condition results even with pressure on only one radial side of the plate faces. Thus, when so depressed the shear plates can no longer adjust to the skin contours.

The condition not mentioned relative to the foregoing in my copending application is that the pressure of the spring which biases the cutting blades against the shear plates must also be light enough to avoid excessive friction on and rapid wear of the cutting surfaces, and with the shear plates so lightly sustained tiltable normal shaving pressure on only one radial side of the plates can cause their surface to lie flat on their solid secondary support and therewith no longer sustain the whole plate surface in contact with the skin.

In the subject modified embodiment the shear plates are supported at their periphery on a spring separate from that which biases the rotary cutting member. This peripheral spring urges the shear plates outward with a bias several times greater than allowable for the cutting member spring, and the bias thereof is so preset that while the shear plates will readily tilt under normal shaving pressure, to flatten them against their solid secondary support would require such pressure as would be unnecessary and uncomfortable in shaving.

The prime object of the modified embodiment is the same as that described for the embodiment disclosed in my above designated patent (provision of efficiently tiltable rotary cutting elements), but it is thought that some manufacturers might consider this embodiment to require less precision in production than the structure with spherically radiused cutting elements, and also that it could allow some decrease in the projection of the shear plates above their retaining plate surface if it was deemed preferable.

These and other objects of the subject modified embodiment of my invention will be apparent from the following description wherein reference is made to the accompanying drawings, and wherein similar numerals designate similar parts throughout the several views and Figures.

STRUCTURAL ELEMENTS

Figure 2:
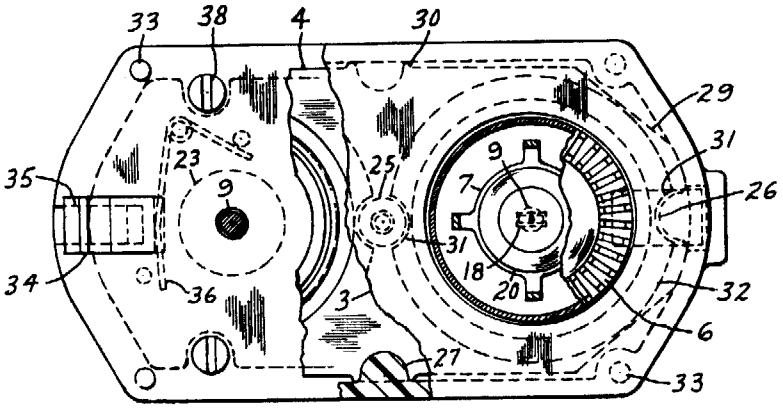
FIG. 2 is a top plan view with portions of the cutting element retaining frame and retaining plate broken away to show the construction of the various components.

With reference to the several Figures, the device may comprise a main housing 1, a housing cover plate 2, a cutting element retaining frame 3, a cutting element retaining plate 4, tiltable cutting elements 5 comprising shear plates 6, rotary cutting members 7, cutting element peripheral supporting springs 8, cutter driving shafts 9, driving gears 10 and 11, and a driving shaft biasing spring 12.

As will be seen, a portion 13 of the annulus of the cutting elements is diametrically enlarged to form a cup with a shoulder 14, one end of the springs 8 being engaged in the cups and seated against the shoulder. The opposite end of the springs is seated on the plate 4 and encompass a centering pilot 15 formed on the plate.

The driving shafts 9 may be formed with a squared portion 16 at one end a flatted portion 17 at their opposite end. The flatted ends may be engaged in loose fitting rectangular driving apertures 18 (FIG. 2) in the cutting members 7, and their squared portion may be drivingly disposed in a loose fitting square chamber 19 in the gears 10.

Affixed to the cutting members, as by spot-welding thereto, is a spherically crowned cap 20. The tips of the flatted ends of the shafts are radiused to conform to the underside of the caps and are urged into abutment therewith under light bias of the spring 12 disposed in the chamber 19. The bias against the caps in turn urge blades 22 of the cutting members into shearing contact with the underside of the shear plates, as shown.

Because the shafts must run slightly off center with the tilting of the cutting elements the shaft squared and flatted ends must fit loosely in their driving connections, as stated, and the shaft encompassing orifices in the plate 2 and gears 10 must be somewhat larger than the diameter of the shafts to allow them to self align. So to preclude hair trimmings or other debris from entering the gear chamber through the oversize apertures rotatable washers 23 are provided which closely fit the shafts and are very lightly sustained against the underside of plate 2 by springs, as 24.

The plate 4 may be secured in frame 3 against bosses 25, 26 and 27 by a screw 28. The plate may be located laterally by portions 29 and 30, which fittingly abut the end and side walls, respectively, of the frame 3, as shown.

The cutting elements 5 may be prevented from rotating by notches 31 in a radially extended flange 32 which loosely engage the bosses 25 and 26.

Frame 3 may be positioned by dowels, as 33, and may be removably secured to cover plate 2 by slide snap fasteners, as 34, which are grooved, as 35, to slide in a slot at each end of the plate. Cantilever springs 36 bias the fasteners to their securing position.

The space 37 between the plates 2 and 4 constitute a a hair clipping receiving chamber.

Figure 3:
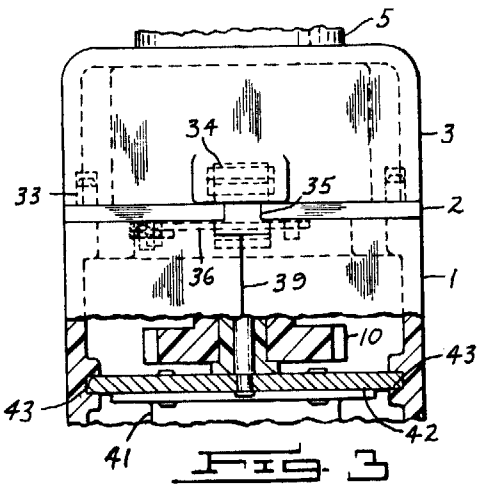
FIG. 3 is an end elevational view with a portion broken away showing other structural details.
Figure 1:
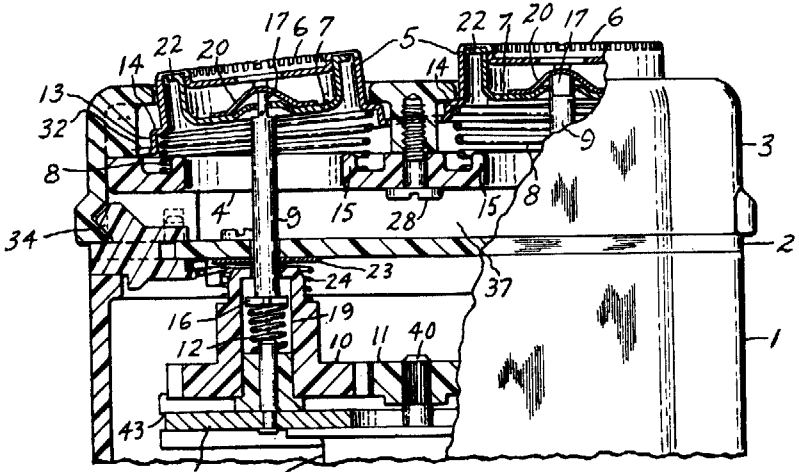
FIG. 1 is a side elevational view of the device with a portion of the housing broken away to show the disposition of the cutting elements and the rotary cutter driving means.

Cover plate 3 may be secured to the housing 1 as by screws 38. The housing may be made in two parts joined together, as indicated at line 39 (FIG. 3), the screws 38 serving to secure the upper portion together while other means (not shown) secures the lower portion.

The drive gear 11 may be affixed, as by press fitting, to a shaft 40 of a motor 41 which may be suitably secured to a plate 42. The latter may be engaged and supported in slots, as 43, formed in the housing side walls.

OPERATION

The bias of the cutting element supporting springs 8 is so preset that under normal efficient shaving pressure the shear plates will readily tilt to diverse angles while their full surface remains in contact with the skin, but under abnormally and unnecessarily heavy shaving pressure the springs may be compressed until the flange 32 of the cutting elements seats solidly on the plate 4.

For disposal of hair clippings or other debris from the chamber 37 the retaining frame 3, with its associated parts, may be snapped on and off the housing cover plate by pushing or pulling it over the angled end of the snap fasteners 34.

For general cleaning when desired the cutting elements and associated parts may easily and quickly be disassembled by removing the one screw 28.

What I claim is:

1. In a rotary dry shaver, a component housing, a universally tiltable cutting element comprising a flanged apertured shear plate exposedly retained in the housing under an apertured frame, a rotary cutting member cooperative with the shear plate and coactively tiltable therewith, a driving shaft for the cutting member, means tiltably connecting the driving shaft to the cutting member, means to bias the cutting member into contact with the shear plate, and the said cutting element tiltably supported in the axial direction by a coil spring surrounding said driving shaft and disposed against the flanged periphery of said shear plate, said spring being separate from the cutting member and its biasing means and the means tiltably connecting the driving shaft to the cutting member.

2. A dry shaver comprising a shaver housing including a shaving head having at least one opening therein, a shear plate disposed within said opening and adapted for universally tilting relative thereto, a cutting member disposed adjacent said opening beneath said shear plate and tiltable with the latter, and means disposed within said head beneath said shear plate and free of said cutting member for floatingly supporting the periphery of said plate for axial movement thereof relative to said opening, the periphery of said shear plate freely resting on said floatingly supporting means.

3. The shaver of claim 2 which includes retainer means fixedly mounting said supporting means within said shaving head in a manner so that said supporting means holds said shear plate and said cutting member in place when said head is removed from the said housing.

4. The shaver of claim 2 in which said supporting means includes stop means to limit inward floating movement of said shear plate.

* * * * *